United States Patent [19]

Brown

[11] Patent Number: 4,932,670

[45] Date of Patent: Jun. 12, 1990

[54] GAME APPARATUS USING A GUN TYPE PROJECTOR

[76] Inventor: Geoffrey R. H. Brown, 8 Leaver Terrace, Christchurch, New Zealand

[21] Appl. No.: 354,770

[22] Filed: May 22, 1989

[51] Int. Cl.[5] ..... A63B 59/02

[52] U.S. Cl. ..... 273/318; 273/1 L; 273/349; 273/412

[58] Field of Search ..... 273/317, 318, 324, 1 R, 273/1 L, 349, 412

[56] References Cited

U.S. PATENT DOCUMENTS

| | | | |
|---|---|---|---|
| 1,667,123 | 4/1928 | Koller | 273/324 |
| 2,636,738 | 4/1953 | Abagoff | 273/324 |
| 3,843,127 | 10/1974 | Lack | 273/349 |

FOREIGN PATENT DOCUMENTS

| | | | |
|---|---|---|---|
| 2327915 | 12/1973 | Fed. Rep. of Germany | 273/324 |
| 1005420 | 9/1965 | United Kingdom | 273/324 |

*Primary Examiner*—William H. Grieb

*Attorney, Agent, or Firm*—Fleit, Jacobson, Cohn, Price, Holman & Stern

[57] ABSTRACT

An apparatus for playing a game using fluid under pressure to propel an object into the air from a gun-like mechanism, the arrangement being such that the rules of the game require the object to be caught by an element associated with the gun-like mechanism or similar device. Two different fluids used are water and air under pressure, and the element associated with the gun-like mechanism may be a bulbous fitting formed integrally with or fitted on the front end of the gun-like mechanism.

6 Claims, 1 Drawing Sheet

GAME APPARATUS USING A GUN TYPE PROJECTOR

FIELD OF THE INVENTION

This invention relates to a gun type projector or adapted for recreational uses and more particularly a game.

BACKGROUND OF THE INVENTION

The object of the invention is to provide recreation in the form of a game in which the participant(s) is kept cool while having fun and enjoyment.

SUMMARY OF INVENTION

According to the present invention a broadest aspect resides in an apparatus for playing a game using fluid under pressure to propel an object into the air from a gun-like mechanism, the arrangement being such that the rules of the game require the object to be caught by a means associated with the same or a similar gun-like mechanism.

Two fluids for this apparatus are envisaged. The different fluids being water and air under pressure.

The means associated with the gun-like mechanism can be a bulbous fitting formed integrally with or fitted on the front end of the gun-like mechanism.

Further aspects of the invention which should be considered in all its novel aspects will become apparent from the following descriptions which are given by way of example only.

BRIEF DESCRIPTION OF THE DRAWINGS

Examples of the invention will now be described with reference to the accompanying drawing in which.

DESCRIPTION OF THE PREFERRED EMBODIMENTS

Figure 1:
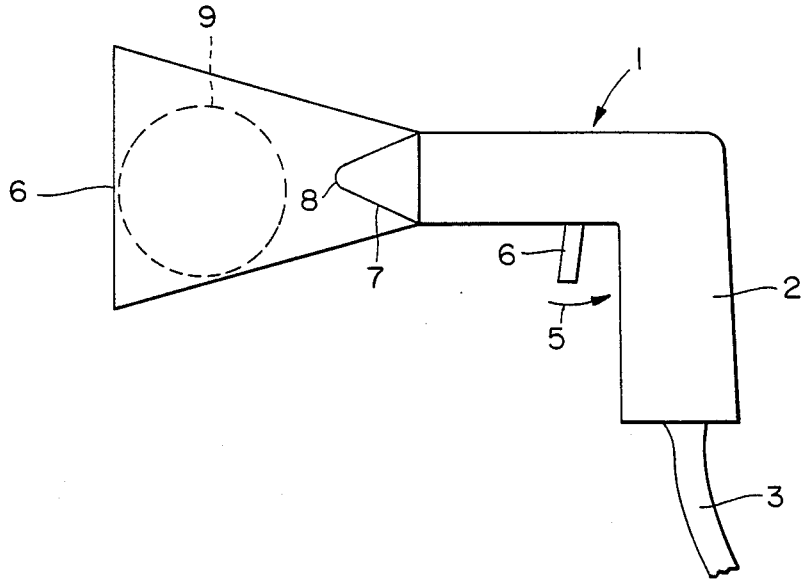
FIG. 1 is a diagramatic side elevational view of an example of the present invention.

In a preferred example shown in FIG. 1 the invention is attached to a leader connected to an ordinary flexible watering hose 3. The invention has a gun-like mechanism 1 the butt or handle 2 of which is adapted for connection to a flexible hose 3 by a snap-fitting connector, for example. The mechanism 1 has a trigger or activating means 4 adapted to control the flow of liquid through the mechanism. The hose 3 may terminate at a Y-fitting or connection (not shown) which allows a hose extension to be fitted to the hose to enable more than one player to play the game.

Alternatively for indoor use a similar system may be adapted to fit with a vacuum cleaner hose if the game is to be played with blown air.

The gun-like mechanism is operated to allow a user thereof to fire a jet of fluid from nozzle 8.

The gun-like mechanism 1 can be a hand operated garden spray gun the shaped front end 7 of which has fitted thereon a bulbous fitting 6. The fitting 6 has an open end which is cone-shaped, bell shaped, cup shaped or U-shaped. This fitting 6 can be formed from a moulded plastics material or wire to form a means for catching therein an object 9. The object 9 can be a table tennis ball, a plastic or rubber practice golf ball or the like.

The user by means of the jet of fluid fires the object from the gun. The aim of the game being to fire the object, for example over a net if two persons are playing and then to catch the object using the bulbous end of the gun. If two players are using the game the principle of the game is to catch the object fired by ones opponent.

If two persons are playing the game the object of the game is for one player to fire the object to the other player who must catch it in order to score a point. It will be appreciated that with water as the fluid a jet of water is sent from the nozzle by the mains water supply to which the hose is connected. The jet of water can be used to wet and distract an opponent while the game is played.

The game can be played on a court divided by a net. The game can be played with rules similar to those of tennis. Penalties can be dealt to a player who fires water at their opponent after the opponent has caught the object.

Figure 2:
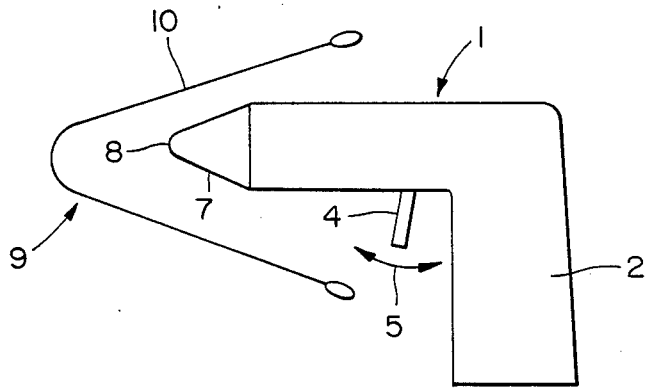
FIG. 2 is a diagramatic side elevational view of an alternative example of the present invention.

In an alternative construction as shown in FIG. 2 with a pistol type gun means 1 without the bulbous fitting 6 a shuttlecock shaped object 9 with its weight reversed i.e. with the widest part at 10 being heaviest may be used.

In use in an outside situation with high pressure water supplied from a hose the game constitutes a fun game for both children and adults.

A possible variation for inside use is to use a vacuum cleaner's air pressure which fires small light balls from an appropriately modified gun mechanism according to the invention.

The game can be played by more than two players if desired.

Examples have been disclosed above and it is envisaged that modifications can take place without departing from the scope of the appended claims.

What we do claim and desire to obtain by Letters Patent of the United States is:

1. A game apparatus for firing and catching an object comprising:
   - at least one gun-like projector having an outlet end and being adapted to be controlled by a player and operable to propel the object into the air by a liquid under pressure;
   - a trigger means on said projector;
   - a bulbous fitting on said outlet end of said projector having a shape for catching the object; and
   - a snap-fitting connecting means on said projector connectable to a liquid conducting hose to facilitate conducting liquid under pressure to said trigger means, so that in playing the game activation of said trigger means directs a jet of water from said outlet end of said gun-like projector which propels the object from the bulbous fitting into the air, the bulbous fitting being usable to catch the object.

2. An apparatus as claimed in claim 1 wherein: said bulbous fitting is cone-shaped.

3. An apparatus as claimed in claim 1 wherein: said bulbous fitting is bell shaped.

4. An apparatus as claimed in claim 1 wherein: said bulbous fitting is cup-shaped.

5. An apparatus as claimed in claim 2 wherein: said bulbous fitting is molded from a plastics material.

6. An apparatus as claimed in claim 2 wherein: said bulbous fitting is fabricated from a metal material.

* * * * *